United States Patent [19]

Saito et al.

[11] Patent Number: 4,614,895

[45] Date of Patent: Sep. 30, 1986

[54] POSTACCELERATION CATHODE RAY TUBE WITH AN ELECTRON LENS SYSTEM FOR DEFLECTION AMPLIFICATION

[75] Inventors: Kimiharu Saito; Osamu Akizuki, both of Hino, Japan

[73] Assignee: Iwatsu Electric Co., Ltd., Tokyo, Japan

[21] Appl. No.: 726,420

[22] Filed: Apr. 24, 1985

[30] Foreign Application Priority Data

May 1, 1984 [JP] Japan ..... 59-88156

[51] Int. Cl.[4] ..... H01J 29/80

[52] U.S. Cl. ..... 313/429; 315/17

[58] Field of Search ..... 313/421, 426, 427, 429, 313/432, 449, 460; 315/17, 19

[56] References Cited

U.S. PATENT DOCUMENTS 3,496,406 2/1970 Deschamps ..... 313/429 X
4,302,704 11/1981 Saito ..... 315/17
4,543,508 9/1985 Saito ..... 313/429

FOREIGN PATENT DOCUMENTS 56-152143 11/1981 Japan .

*Primary Examiner*—Stewart J. Levy
*Assistant Examiner*—Joseph W. Roskos
*Attorney, Agent, or Firm*—Woodcock Washburn Kurtz Mackiewicz & Norris

[57] ABSTRACT

A generally box shaped, electronic lens system for use in a cathode ray tube for amplification of both horizontal and vertical deflection of the electron beam. The lens system comprises two or three electrodes arranged in axial alignment, with an insulating gap or gaps therebetween, so as to encompass the beam trajectories from the deflection system to the target of the CRT. The action of the lens system on the beam is divergent in a horizontal direction and convergent in a vertical direction. The target side electrode has its beam exit end closed by an end plate having defined therein an aperture elongated horizontally. The CRT includes a post-accelerating electrode whose field acts on the beam exit end of the lens system, creating an additional lens at the end plate aperture. The vertical dimension of the aperture gradually increases, and then gradually decreases, from the midpoint toward the opposite extremities of its horizontal dimension. So shaped, the end plate aperture serves to amplify beam deflection in the horizontal direction without a sacrifice of linearity.

14 Claims, 21 Drawing Figures

POSTACCELERATION CATHODE RAY TUBE WITH AN ELECTRON LENS SYSTEM FOR DEFLECTION AMPLIFICATION

BACKGROUND OF THE INVENTION

Our invention relates to cathode ray tubes (CRTs) in general and, in particular, to those of the type having an electron lens system for amplifying, in coaction with a postaccelerating or intensifier electrode, the deflections of the electron beam in both horizontal and vertical directions. More particularly, our invention concerns improvements in the electron lens system of the kind described and claimed in U.S. Pat. No. 4,302,704 filed by Saito and assigned to the assignee of the instant application. The improved lens system of our invention, herein referred to as the scan expansion lens system, finds use in oscilloscope and storage CRTs, among other applications.

The scan expansion lens system according to the above cross referenced U.S. Pat. No. 4,302,704 comprises three boxlike lens elements or electrodes arranged end to end, with insulating gaps therebetween, so as to encompass the trajectories of the electron beam from the deflection system to the target of the CRT. The target side electrode of this prior art lens system has its beam exit end closed by an end plate having defined therein an aperture or slot elongated horizontally. So constructed, the conventional lens system provides a divergent electron lens for the beam that has been deflected horizontally, and two successive convergent electron lenses for the beam that has been deflected vertically, one of the two convergent lenses being produced at and adjacent the end plate aperture of the target side electrode by the field of the postaccelerating electrode. The apertured end plate, which distinguishes this known lens system from the more conventional ones such as disclosed, for example, in U.S. Pat. No. 3,496,406 to Dechamps, has proved to be of immense utility for the attainment of high deflection sensitivity without spot defocusing and the improved linearity of the deflection factor in a vertical direction.

We have found, however, a weakness in this prior art scan expansion lens system. Its end plate aperture is of constant width or vertical dimension throughout its horizontal dimension. Consequently, the horizontal potential distribution at and adjacent this end plate, due to the potential difference between the target side electrode of the lens system and the postaccelerating electrode, is so linear that it serves little or no purpose for the magnification of horizontal beam deflection. The utility of the lens system will certainly be still more enhanced if its end plate aperture works also for the improvement of linearity in the horizontal deflection factor.

A conventional solution to this problem is found in Japanese Laid Open Patent Application No. 56-152143 laid open to public inspection on Nov. 29, 1981. This prior Japanese application suggests an end plate aperture gradually increasing in width from the midpoint to its horizontal dimension toward both ends. The solution has proved unsatisfactory, however. The end plate aperture of the above modified shape can amplify horizontal deflection only at the sacrifice of the linearity of the horizontal deflection factor.

SUMMARY OF THE INVENTION

We have hereby found a truly satisfactory solution, in a CRT incorporating the scan expansion lens system of the kind in question, to the problem of how to design the end plate aperture of the lens system so as to cause the same to serve for the magnification of beam deflections in two orthogonal directions for the optimum linearity of deflection factors in both directions.

Briefly, our invention provides apparatus including a cathode ray tube having an electron gun for emitting a beam of electrons directed toward a target, deflection means disposed along the path of the beam for deflecting the beam in two orthogodirections (vertical and horizontal), a scan expansion lens system disposed along the path of the beam intermediate the deflection means and the target for amplifying the deflections of the beam, and a postaccelerating electrode disposed so that an electric field due to the postaccelerating electrode acts at least upon a target side end portion of the lens system.

Stated in its simplest form, the scan expansion lens system comprises first and second tubular electrodes of substantially rectangular cross sectional shape disposed in axial alignment to allow the passage of the beam therethrough and spaced apart from each other with a gap sufficient to electrically insulate them from each other. Each of the first and second electrodes has a first pair of opposite sides disposed in one of the two orthogonal directions of beam deflection (e.g. horizontal) and a second pair of opposite sides disposed in the other of the orthogonal directions (e.g. vertical). At least either of the beam exit ends of the first pair of opposite sides of the first electrode and the beam entrance end of the first pair of opposite sides of the second electrode are each curved in an arc that is convex in a prescribed direction (i.e. either toward the electron gun or toward the target). The second electrode is further provided with an end plate closing the beam exit end thereof, the end plate having defined therein an aperture generally elongated in said one of the orthogonal directions. The width, or the dimension in said other of the orthogonal directions, of this end plate aperture gradually increases, and then gradually decreases, from its midpoint toward its opposite extremities in said one of the orthogonal directions.

Additionally included in the apparatus are means for applying suitable electrical potentials to the first and second electrodes of the lens system and to the postaccelerating electrode. In response to such applied potentials the lens system as a whole operates to amplify the deflections of the beam in both of the orthogonal directions by providing a generally divergent lens action in said one of the orthogonal directions and a generally convergent lens action in the other. Further, having been improved in shape as above, the end plate aperture of the second electrode functions to amplify beam deflection in said one of the orthogonal directions (e.g. horizontal) for higher linearity of the deflection factor in that direction.

The end plate aperture of the above improved shape is applicable to lens systems of various configurations, including those having not only two but also three electrodes. We will disclose several such lens systems. The above and other features and advantages of our invention will become more apparent, and the invention itself will best be understood, from such disclosure, as well as from the claims appended hereto, taken together with the attached drawings.

DESCRIPTION OF THE PREFERRED EMBODIMENTS

CRT Configuration

Figure 1:
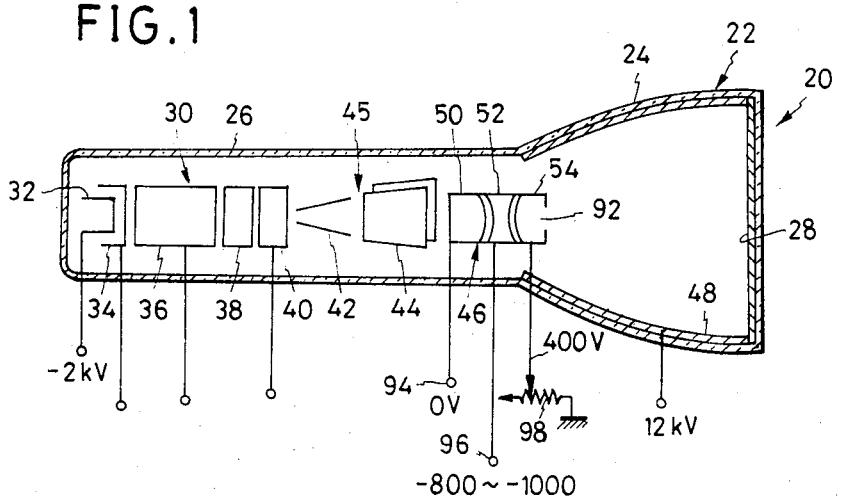
FIG. 1 is a diagrammatic longitudinal section through a typical form of the CRT to which our invention is applicable, the CRT being shown together with a preferred form of the scan expansion lens system in accordance with our invention mounted in place therein.
Figure 2:
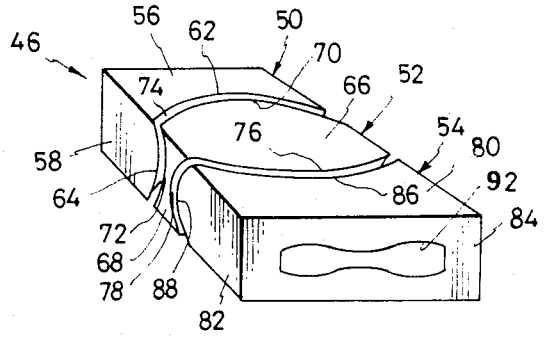
FIG. 2 is an enlarged perspective view of the lens system used in the CRT of FIG. 1.
Figure 3:
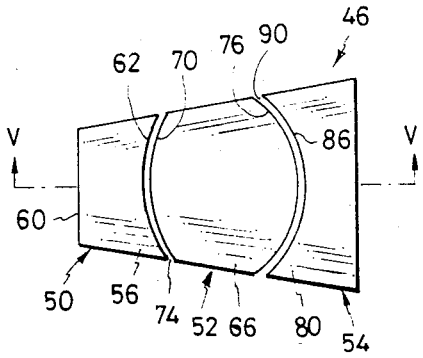
FIG. 3 is a plan view of the lens system.
Figure 4:
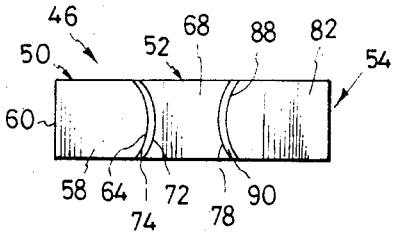
FIG. 4 is an elevation of the lens system, as seen from the left hand side in FIG. 2.
Figure 5:
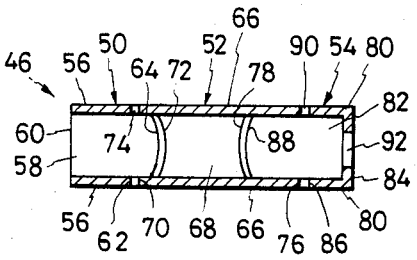
FIG. 5 is a section through the lens system, taken along the line V—V in FIG. 3.

We will now describe our invention in detail as specifically adapted for a CRT of the electrostatic focus and deflection type for oscilloscopic applications. Generally designated 20 in FIG. 1, the exemplified CRT has an evacuated envelope 22 of glass or like insulating material. The envelope 22 includes a funnel portion 24 and a neck portion 26 integrally joined in axial alignment. The funnel portion 24 of the envelope 22 has a target 28 in the form of a fluorescent screen of any known or suitable design on its front end, directed to the right in FIG. 1.

The neck portion 26 of the envelope 22 has an electron gun 30 mounted therein adjacent its end away from the target 28. The electron gun 30 comprises a cathode 32, first grid 34, second grid 36, first anode 38, and second anode 40. The electron gun 30 is arranged axially of the envelope neck portion 26 and operates to emit a beam of electrons directed toward the target 28. On its way from electron gun 30 to target 28 the electron beam passes a pair of vertical deflection plates 42 and then a pair of horizontal deflection plates 44. The vertical deflection plate pair 42 and horizontal deflection plate pair 44, constituting in combination a deflection system 45, operate in the known manner to deflect the electron beam vertically and horizontally. We are herein using the terms "vertical" and "horizontal", and derivatives thereof, in accordance with common parlance in the art; they do not necessarily imply that the beam is deflected vertically and horizontally in the exact senses of the words. All that is required, of course, is that the beam be deflected in two orthogonal directions by the deflection system 45.

Also disposed along the path of the electron beam, and intermediate horizontal deflection plate pair 44 and target 28, is a three element, generally trapezoidal box shaped scan expansion lens system 46 to which our invention particularly pertains. The scan expansion lens system 46 acts to amplify both vertical and horizontal deflections of the electron beam so as to provide full coverage of the target 28, as will become apparent as the description progresses.

The envelope funnel portion 24 bears a conductive coating 48 on its interior surface which serves as a postaccelerating or postdeflection electrode, encompassing the path of the electron beam from scan expansion lens system 46 to target 28. The location of the lens system 46 with respect to the postaccelerating electrode 48 is such that the field of the electrode 48 acts at least on the target side or beam exit end portion of the lens system. This positional relationship between lens system 46 and postaccelerating electrode 48 is essential for the proper functioning of the lens system.

The target 28, electron gun 30, deflection system 45, and postdeflecting electrode 48 can each be of standard design and, as a whole, of standard arrangement. No more detailed discussion of these components will therefore be necessary. Our present invention particularly features the scan expansion lens system 46 and its structural and functional relations with the other components of the CRT 20.

Scan Expansion Lens System

An inspection of FIGS. 2 through 5, in particular, will reveal that the particular scan expansion lens system 46 shown here comprises three substantially tubular electrodes or lens elements of sheet metal material, consisting of a first or gun side electrode 50, a second or intermediate electrode 52, and a third or target side electrode 54. All these electrodes 50, 52 and 54 each have a rectangular cross sectional configuration and are disposed end to end in axial alignment with the path of the nondeflected beam from electron gun 30 to target 28. The lens system 46 as a whole is substantially box shaped, the term "substantially" being used because the lens system is trapezoidal in shape when seen in a plan view as in FIG. 3, gradually increasing in width from its gun side end toward its target side end. A more detailed discussion of the individual electrodes 50, 52 and 54 of the lens system 46 follows.

The gun side electrode 50 comprises a first pair of opposite sides 56 disposed in one of the two orthogonal directions of beam deflection, namely, horizontally, and a second pair of opposite sides 58 disposed in the other of the two orthogonal directions, namely, vertically. The beam entrance ends 60, directed toward the electrode gun 30, of the two pairs of opposite sides 56 and 58 are all straight and extend at right angles with the axis of the CRT 20. The beam exit ends 62, directed toward the target 28, of the first pair of opposite sides 56 are each curved in an arc of a constant or varying radius that is convex in a first direction, that is, toward the electron gun 30. The beam exit ends 64 of the second pair of opposite sides 58 are each curved in an arc of a constant or varying radius that is convex in a second direction opposite to the first direction, that is, toward the target 28.

The intermediate electrode 52 of the lens system 46 likewise comparises a first pair of opposite sides 66 disposed in a coplanar relationship to the first pair of opposite sides 56 of the gun side electrode 50, and a second pair of opposite sides 68 disposed in a coplanar relationship to the second pair of opposite sides 58 of the gun side electrode. The beam entrance ends 70 of the first pair of opposite sides 66 of the intermediate electrode 52 are shaped in conformity with the first pair of opposite sides 56 of the gun side electrode 50; that is, the ends 70 of the sides 66 are each curved in an arc of a constant or varying radius that is convex toward the electron gun 30. The beam entrance ends 72 of the second pair of opposite sides 68 of the intermediate electrode 52 are also shaped in conformity with the beam exit ends 64 of the second pair of opposite sides 58 of the gun side electrode 50; that is, the ends 72 of the sides 68 are each curved in an arc of a constant or varying radius that is convex toward the target 28.

A gap 74 exists between gun side electrode 50 and intermediate electrode 52. This gap must be sufficient to electrically isolate the two electrodes 50 and 52 one from the other.

The beam exit ends 76 of the first pair of opposite sides 66 of the intermediate electrode 52 are each curved in an arc of a constant or varying radius that is convex toward the target 28. The beam exit ends 78 of the second pair of opposite sides 68 of the intermediate electrode 52 are each curved in an arc of a constant or varying radius that is convex toward the electron gun 30.

The target side electrode 54 of the lens system 46 comprises a first pair of opposite sides 80, a second pair of opposite sides 82, and an apertured end plate 84 closing the beam exit end of the target side electrode. The first pair of opposite sides 80 of the target side electrode 54 have a coplanar relationship to the first pair of opposite sides 66 of the intermediate electrode 52 and hence to the first pair of opposite sides 56 of the gun side electrode 50. The second pair of opposite sides 82 of the target side electrode 54 have a coplanar relationship to the second pair of opposite sides 68 of the intermediate electrode 52 and hence to the second pair of opposite sides 58 of the gun side electrode 50.

The beam entrance ends 86 of the first pair of opposite sides 80 of the target side electrode 54 are each curved in an arc of a constant or varying radius that is convex toward the target 28, in conformity with the beam exit ends 76 of the first pair of opposite sides 66 of the intermediate electrode 52. The beam entrance ends 88 of the second pair of opposite sides 82 of the target side electrode 54 are each curved in an arc of a constant or varying radius that is convex toward the electron gun 30, in conformity with the beam exit ends 78 of the second pair of opposite sides 68 of the intermediate electrode 52.

A gap 90 also exists between intermediate electrode 52 and target side electrode 54, electrically insulating them from each other. The beam exit ends of the two pairs of opposite sides 80 and 82 of the target side electrode 54 are all straight and at right angles with the axis of the CRT 20.

Figure 6:
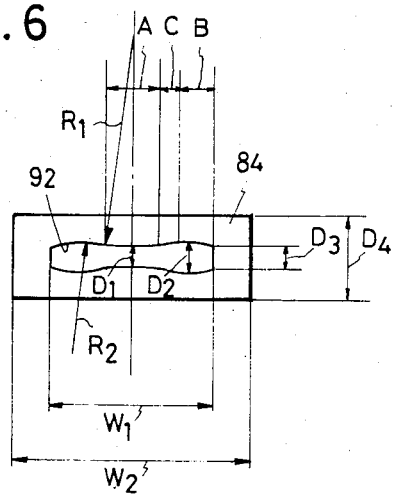
FIG. 6 is an elevation of the lens system, as seen from the right hand side of FIG. 5, the view being explanatory of detailed configuration of the end plate aperture of the lens system.

As best shown in FIG. 6, the apertured end plate 84 of this particular embodiment is flat and rectangular in shape and is welded or otherwise affixed to the beam exit end of the target side electrode 54. The aperture 92 in this end plate 84 is disposed centrally therein and, in the illustrated embodiment, generally elongated horizontally. The width or verticall dimension of the aperture 92 increases gradually from the midpoint of its horizontal dimension approximately halfway toward its opposite extremities and then decreases gradually.

The following is the preferred dimensional specifications of the scan expansion lens system 46, given on the assumption that the target screen of the CRT 20 has a vertical dimension of eight centimeters (cm) and a horizontal dimension of 10 cm:

The axial dimension of the complete lens system 46: 35 mm.

The vertical dimension of the lens system 46: 13 mm.

The horizontal dimension of the beam entrance end 60: 16 mm.

The horizontal dimension of the end plate 84: 30 mm.

Although we have stated that the meeting ends of the three electrodes 50, 52 and 54 of the lens system 46 can be curved in arcs of either constant or varying radii, this is a general statement. Such ends are all curved with constant radii in this particular embodiment. The following, then, are the preferred radii of curvature of the meeting ends of the lens system electrodes 50, 52 and 54:

The meeting ends 62 and 70 of the gun side 50 and intermediate 52 electrodes: 27 mm.

The meeting ends 64 and 72 of the gun side 50 and intermediate 52 electrodes: 8 mm.

The meeting ends 76 and 86 of the intermediate 52 and target side 54 electrodes: 27 mm.

The meeting ends 78 and 88 of the intermediate 52 and target side 54 electrodes: 8 mm.

We will also specify the currently preferred dimensions the aperture 92 in the end plate 84 of the scan expansion lens system 46, with reference directed to FIG. 6.

The vertical dimension D1 at the midpoint of the horizontal dimension: 4 mm.

The maximum vertical dimension D2: 6 mm.

The vertical dimension D3 at either extremity in horizontal direction: 4 mm.

The horizontal dimension W1: 28 mm.

The end plate 84 has a vertical dimension D4 of 13 mm and a horizontal dimension W2 of 30 mm as aforesaid. As indicated also in FIG. 6, the pair of opposite edges generally extending horizontally and bounding the aperture 92 are each composed of a convex central portion A curved with a radius R1, a pair of concave extreme portions B each curved with a radius R2, and a pair of linear portions C intermediate the central portion A and extreme portions B. All in all, the aperture 92 is of bilateral symmetry, both horizontally and vertically, about the axis of the nondeflected electron beam from the electron gun 30 to target 28 of the CRT 20.

With reference back to FIG. 1 the electron gun 30 and postaccelerating electrode 48 of the CRT 20 are provided with voltage supply terminals, as shown, for the application of required operating potentials. The gun side electrode 50 and intermediate electrode 52 of the scan expansion lens system 46 are provided with voltage supply terminals 94 and 96, respectively, whereas the target side electrode 64 is connected to a potentiometer 98 for adjustably varying the potential applied thereto, for a purpose yet to be described.

Operation

Since the configuration of CRT 20 is largely conventional except for the scan expansion lens system 46, we will only describe the operation of this lens system in detail. As indicated in FIG. 1, a −2 kilovolt (kV) potential may be applied to the cathode 32 of the electron gun 30. Further, for the functioning of the lens system 46 for deflection amplification, a 0 V potential may be applied to its gun side electrode 50, from −800 to −1000 volts potential to its intermediate electrode 52, and +400 volt potential to its target side electrode 54. The postaccelerating electrode 48, which bears particular pertinence to the operation of the lens system 46, may be applied with a +12 kV potential.

Figure 7:
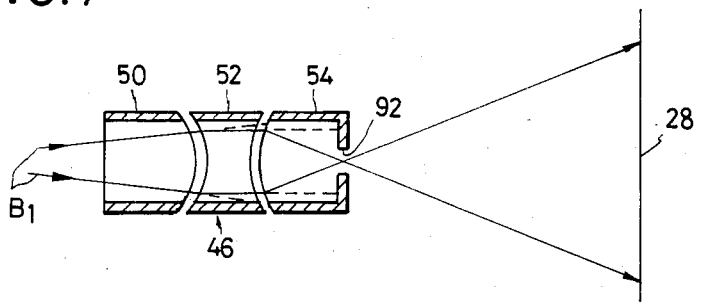
FIG. 7 is a diagrammatic illustration of the deflection amplifying action of the lens system in a vertical direction.
Figure 8:
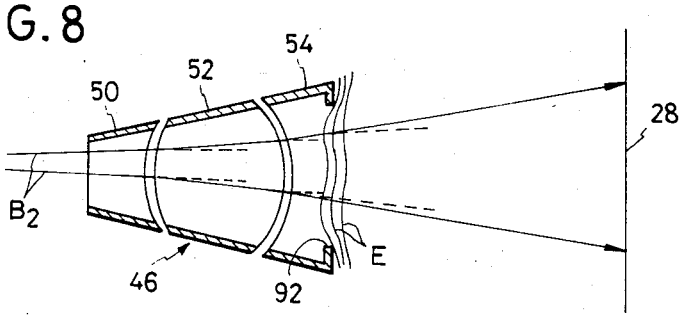
FIG. 8 is a similar illustration of the deflection amplifying action of the lens system in a horizontal direction, the view also showing the horizontal distribution of equipotentials at and adjacent the end plate aperture of the improved shape.

FIG. 7 depicts the consequent action of the scan expansion lens system 46 in a vertical direction, and FIG. 8 the lens action in a horizontal direction. The reference characters B1 in FIG. 7 indicate the opposite extreme trajectories of the electron beam that has been deflected vertically by the vertical deflection plate pair 42. The vertically deflected beam does not follow the phantom straight line paths within the lens system 46 but follows the solid line trajectories B1. Then, passing the aperture 92 in the end plate 84 of the target side electrode 54, the beam bombards the target 28. It will be seen that the traveling direction of the vertically deflected beam is so changed within the lens system 46 that its opposite trajectories B1 cross over, with the consequent amplification of the vertical deflection. The action of the lens system 46 on the vertically deflected beam is convergent. The vertical potential distribution at and adjacent the end plate aperture 92, in particular, due to the potential difference between target side electrode 54 and postaccelerating electrode 48 is such that a converging electron lens is created for focusing the beam on the target 28 in any vertical position thereon.

FIG. 8 indicates the opposite extreme trajectories B2 of the beam that has been deflected horizontally by the horizontal deflection plate pair 44. The horizontally deflected beam does not follow the phantom straight line paths but, with its horizontal deflection angle magnified by the lens system 46, traces the solid line trajectories B2 to the target 28 through the end plate aperture 92. Thus the lens system 46 offers a divergent action on the horizontally deflected beam.

The fundamental operation of the lens system 46, as so far set forth, is conventional and is described in the noted Saito U.S. Pat. No. 4,302,704. Reference may be had to that patent for further details in the lens system operation except, of course, for the functioning of the end plate aperture 92 with respect to the horizontally deflected beam. We will explain such functioning of the end plate aperture 92 hereinbelow.

At E in FIG. 8 are shown equipotential lines representative of the horizontal potential distribution at and adjacent the end plate aperture 92, due to the potential difference between the target side electrode 54 of the lens system 46 and the postaccelerating electrode 48. As will be understood from a comparison of FIG. 8 with FIGS. 2 or 6, the horizontal potential distribution depends largely upon the varying widths or vertical dimensions D1, D2 and D3 of the end plate aperture 92. The field of the postaccelerating electrode 48 intrudes not so deep into the lens system 46 through its end plate aperture 92 as its center and opposite end portions of the reduced width than at its portions of greater width. Generally, the greater the width of the end plate aperture 92, the more deeply does the field of the postaccelerating electrode 49 intrude into the lens system 46. Thus, at the midportion of the end plate aperture 92 in the horizontal direction, the equipotentials E become convexed toward the target 28. This convex part of the equipotentials E function to magnify the horizontal deflections of the beam.

It will also be understood from FIG. 8 that those parts of the equipotentials E which are at and adjacent the opposite extreme portions of the end plate aperture 92, where its vertical dimension decreases, do not take part in the magnification of horizontal beam deflections. This presents no problem, however, as those parts of the equipotentials which do not amplify horizontal beam deflections can be made to fall outside the quality area of the target screen.

As has been stated, the width of the end plate aperture 92 gradually decreases from the points of the maximum dimension D2 toward the opposite extremities of the minimum dimension D3. This gradual reduction of the width of the end plate aperture 92 toward its opposite extremities is effective to correspondingly limit the intrusion of the postaccelerating field at and adjacent the maximum width (D2) portions of the aperture which correspond to the opposite lateral end portions of the quality area of the target screen. With the horizontal deflection amplifying capability of the end plate aperture 92 thus reduced at and adjacent it portions of the maximum width D2, the horizontal deflection factor becomes remarkably more linear than if the end plate aperture is of constant vertical dimension as in the noted U.S. Pat. No. 4,302,704.

In the aforementioned Japanese Laid Open Patent Application No. 56-152143, on the other hand, the end plate aperture gradually increases in its vertical dimension from the midpoint toward its opposite extremities. In that case the end plate aperture amplifies the horizontal deflections of the beam either too much or too little at its opposite extreme portions, adversely affecting the linearity of the horizontal deflection factor.

The improved shape of the end plate aperture 92 in accordance with out invention might give rise to the so called "barrel distortion" wherein the image of a square would appear barrel shaped. This display defect is easy to eliminate as the target side electrode 54 of the lens system 46 is connected to the potentiometer 98 for adjustably varying the potential applied thereto. The 400 V potential impressed from potentiometer 98 to target side electrode 54 in the present embodiment is calculated to eliminate barrel distortion. As the potential difference between the intermediate electrode 52 and target side electrode 54 of the lens system 46 is thus made greater than heretofore, the internal lens action of the lens system is enhanced, thereby causing the internal lens to tend to produce "pincushion distortion". Ths pincushion distortion tendency of the internal lens counteracts the barrel distortion tendency of the lens created at the end plate aperture 92, with the consequent display of an undistorted image on the screen.

All in all, as we have ascertained from experiment, the improved scan expansion lens system 46 of our invention with its end plate aperture 92 realizes from 15 to 20 percent improvement in the horizontal deflection factor without a sacrifice of linearity as compared with the prior art lens system with the end plate aperture of the rectangular shape.

Figure 9:
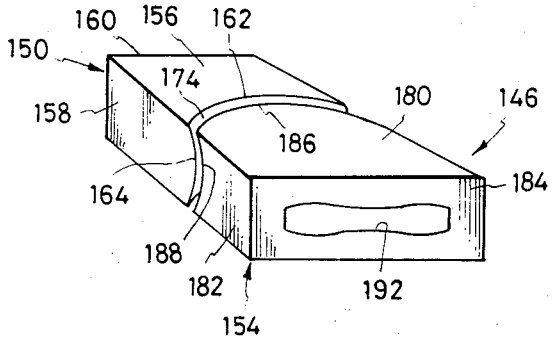
FIG. 9 is a perspective view of another preferred form of the scan expansion lens system in accordance with our invention, for use in the CRT of FIG. 1 in substitution for the first preferred form of the lens system.

Embodiment of FIG. 9

The improved end plate aperture in accordance with our invention finds application in scan expansion lens systems of various configurations other than the three electrode, end to end arrangement of FIGS. 1 through 8. FIG. 9 shows a second preferred form of the scan expansion lens system for use in the CRT 20 of FIG. 1 in substitution for the first described lens system 46. Generally labeled 146, this lens system is of two electrode, end to end construction, comprising a gun side electrode 150 and a target side electrode 152 in axial alignment, there being no intermediate electrode therebetween.

The gun side electrode 150 comprises a first pair of opposite sides 156, one seen, disposed horizontally, and a second pair of opposite sides 158, one seen, disposed vertically. The beam entrance ends 160 of the two pairs of opposite sides 156 and 158 are all straight and extend at right angles with the axis of the CRT 20. The beam exit ends 162 of the first pair of opposite sides 156 are each curved in an arc of a constant or varying radius that is convex toward the electron gun 30. The beam exit ends 164 of the second pair of opposite sides 158 are each curved in an arc of a constant of varying radius that is convex toward the target 28.

The target side electrode 154 of the lens system 146 comprises a first pair of opposite sides 180, one seen, disposed horizontally, a second pair of opposite sides 182, also one seen, disposed vertically, and an apertured end plate 184 closing the beam exit end of the target side electrode. The beam entrance ends 186 of the first pair of opposite sides 180 of the target side electrode 154 are each curved in an arc of a constant or varying radius that is convex toward the electron gun 30, with a radius of curvature similar to that of the beam exit ends 162 of the first pair of opposite sides 156 of the gun side electrode electrode 150. The beam entrance ends 188 of the second pair of opposite sides 182 of the target side electrode 154 are each curved in an arc of a constant or varying radius that is convex toward the target 28, with a radius of curvature similar to that of the beam exit ends 164 of the second pair of opposite sides 158 of the gun side electrode 150.

A gap 174 exists between gun side electrode 150 and target side electrode 154, electrically isolating them from each other. The beam exit ends of the two pairs of opposite sides 180 and 182 of the target side electrode 154 are all straight and at right angles with the axis of the CRT 20.

The apertured end plate 184 of this FIG. 9 embodiment is also flat and rectangular in shape and is welded or otherwise affixed to the beam exit end of the target side electrode 154. The aperture 192 in this end plate 184 is of the same shape as that of the end plate aperture 92 of the FIGS. 1 through 8 embodiment.

In the use of this scan expansion lens system 146, as incorporated in the CRT 20 of FIG. 1, a potential of 0 V may be impressed to the gun side electrode 150, and that of from −900 to −1200 V to the target side electrode 154. Further, by applying a potential of 12 kV to the postaccelerating electrode 48, the lens system 146 will operate in a manner akin to the operation of the lens system 46 set forth in connection with FIGS. 7 and 8.

Figure 10:
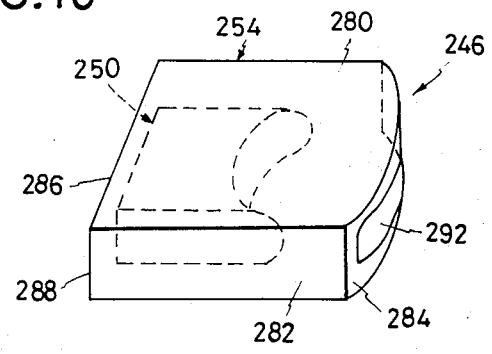
FIG. 10 is a perspective view of still another preferred form of the scan expansion lens system in accordance with our invention.
Figure 11:
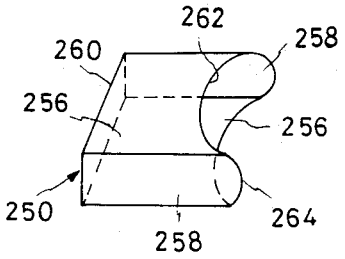
FIG. 11 is a perspective view of the inner electrode of the lens system of FIG. 10.
Figure 12:
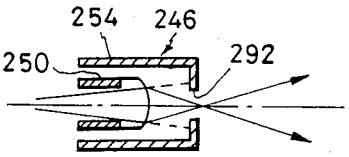
FIG. 12 is a vertical section through the lens system of FIG. 10, the view being explanatory of the deflection amplifying action of the lens system in a vertical direction.

Embodiment of FIGS. 10–12

A scan expansion lens system 246 of FIGS. 10 through 12 also has two electrodes 250 and 254. These electrodes are, however, not in end to end arrangement; instead, the electrode 250 is wholly nested in the electrode 254 in axial alignment. In this embodiment, therefore, we will refer to the electrode 250 as the inner electrode, and to the other electrode 254 as the outer electrode.

As illustrated by itself in FIG. 11, the inner electrode 250 of the lens system 246 comprises a first pair of opposite sides 256 disposed horizontally, and a second pair of opposite sides 258 disposed vertically. The beam entrance ends 260 of the two pairs of opposite sides 256 and 258 are all straight and extend at right angles with the axis of the CRT 20. The beam exit ends 262 of the first pair of opposite sides 256 are each curved in an arc of a constant or varying radius that is convex toward the electron gun 30. The beam exit ends 264 of the second pair of opposite sides 258 are each curved in an arc of a constant or varying radius that is convex toward the target 28.

With reference again to FIG. 10 the outer electrode 254 of the lens system 246, which is made considerably greater in size than the inner electrode 250 for thoroughly surrounding the same in axial alignment, comprises a first pair of opposite sides 280, one seen, disposed horizontally, a second pair of opposite sides 282, also one seen, disposed vertically, and an apertured end plate 284 closing the beam exit end of the outer electrode. The beam entrance ends 286 and 288 of the two pairs of opposite sides 280 and 282 of the outer electrode 254 are all straight and are arranged in a plane perpendicular to the axis of the CRT 20. The beam exit ends of the first pair of opposite sides 280 are each curved in an arc of a constant or varying radius that is convex toward the target 28, whereas the beam exit ends of the second pair of opposite sides 282 are straight.

Closing the beam exit end of the outer electrode 254, the apertured end plate 284 is curved in an arc that is convex toward the target 28, with the same constant or varying radius of curvature as that of the beam exit ends of the first pair of opposite sides 280 of the outer electrode. The aperture 292 in this end plate is of the same shape as that of the aperture 92 best illustrated in FIG. 6.

The inner electrode 250 is nested centrally in the outer electrode 254, with clearances on all four sides, so that the two electrodes are electrically isolated from each other. The clearances between the first pair of opposite sides 256 of the inner electrode 250 and the first pair of opposite sides 280 of the outer electrode 254 are equal to each other, and so are the clearances between the second pair of opposite sides 258 of the inner electrode 250 and the second pair of opposite sides 282 of the outer electrode 254. The curved beam exit ends 262 and 264 of the inner electrode 250 are substantially distanced away from the apertured end plate 284 of the outer electrode 254.

Thus, in this lens system 246, it is only the dimensions of the outer electrode 254 that determine the size of the lens system, the other electrode 250 being completely accommodated in the outer electrode. The lens system 246 is particularly well for the provision of a compact, inexpensive CRT. Notwithstanding the showings of FIGS. 10 and 12, however, it is not an absolute requirement that the inner electrode 250 be thoroughly enclosed in the outer electrode 254. The lens system 246 will fully perform the intended functions if only the beam exit end portion of the inner electrode 250 is received in the outer electrode 254.

FIG. 12 is explanatory of the operation of the scan expansion lens system 246. Upon application of a potential of 0 V to the inner electrode 250, that of −100 to −1300 V to the outer electrode 254, and that of 12 kV to the postaccelerating electrode 48, the end plate aperture 292 of this lens system 246 will function to improve the horizontal deflection factor without loss or diminution of the linearity.

Figure 13:
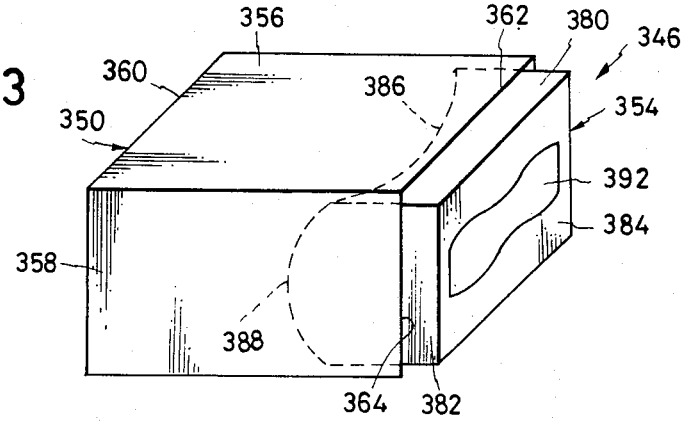
FIG. 13 ia a perspective view of a further preferred form of the scan expansion lens system in accordance with our invention.
Figure 14:
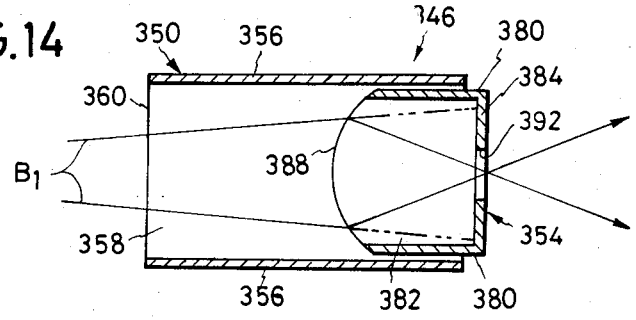
FIG. 14 is a vertical section through the lens system of FIG. 13, the view being explanatory of the deflection amplifying action of the lens system in a vertical direction.
Figure 15:
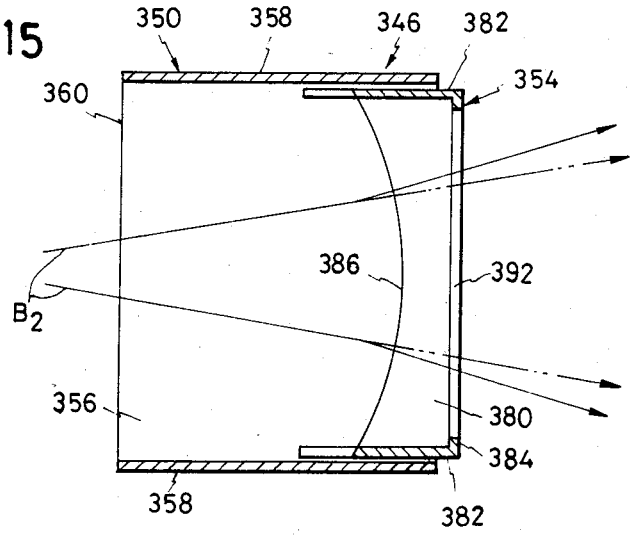
FIG. 15 is a horizontal section through the lens system of FIG. 13, the view being explanatory of the deflection amplifying action of the lens system in a horizontal direction.

Embodiment of FIGS. 13–15

A scan expansion lens system 346 of FIGS. 13 through 15 is also of nested two electrode construction, comprising a gun side electrode 350 and a target side electrode 354. In this embodiment, however, the target side electrode 354 is partly nested in the gun side electrode 350 in axial alignment, so that we will refer to the gun side electrode 350 as the outer electrode, and to the target side electrode 354 as the inner electrode.

The outer electrode 350 of the lens system 346 comprises a first pair of opposite sides 356 disposed horizontally, and a second pair of opposite sides 358 disposed vertically. The beam entrance ends 360 of the two pairs of opposite sides 356 and 358 are all straight and extend at right angles with the axis of the CRT 20. The beam exit ends 362 and 364 of the two pairs of opposite sides 356 and 358 are also straight and at right angles with the axis of the CRT 20. In short, the outer electrode 350 is exactly boxlike in shape, open at both ends.

The inner electrode 354 of the lens system 346, which is considerably less in axial dimension than the outer electrode 350, comprises a first pair of opposite sides 380 disposed horizontally, a second pair of opposite sides 382 disposed vertically, and an apertured end plate 384 closing the beam exit end of the inner electrode. The beam entrance ends 386 of the first pair of opposite sides 380 of the inner electrode 354 are each curved in an arc of a constant or varying radius that is convex toward the target 28. The beam entrance ends 388 of the second pair of opposite sides 382 of the inner electrode 354 are each curved in an arc of a constant or varying radius that is convex toward the electron gun 30. The beam exit ends of the two pairs of opposite sides 380 and 382 are all straight and are arranged in a plane perpendicular to the axis of the CRT 20.

Closing the beam exit end of the inner electrode 354, the end plate 384 is flat and has defined therein an aperture 392 of the same shape as that of the aperture 92 best illustrated in FIG. 6.

The inner electrode 354 is received partly in the outer electrode 350, partly projecting from its beam exit end toward the target 28, and is electrically isolated therefrom. The clearances between the first pair of opposite sides 356 of the outer electrode 350 and the first pair of opposite sides 380 of the inner electrode 354 are equal to each other, and so are the clearances between the second pair of opposite sides 358 of the outer electrode 350 and the second pair of opposite sides 382 of the inner electrode 354.

FIG. 14 indicate at B1 the opposite extreme trajectories of the vertically deflected electron beam through the lens system 346. FIG. 15 likewise indicate at B2 the opposite extreme trajectories of the horizontally deflected beam through the lens system 346. A potential of 0 V may be impressed to the outer electrode 350, that of 1.6 kV to the inner electrode 354, and that of 17.5 kV to the postaccelerating electrode 48, to cause the lens system 346 to amplify both vertical and horizontal deflections of the beam as in FIGS. 14 and 15. It will be appreciated from FIG. 15 that the end plate aperture 392 of the improved shape functions just like the end plate aperture 92 of the lens system 46.

Figure 16:
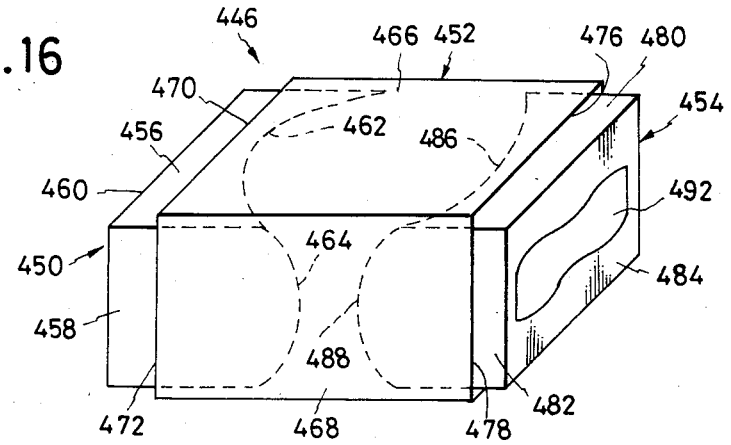
FIG. 16 is a perspective view of a further preferred form of the scan expansion lens system in accordance with our invention.
Figure 17:
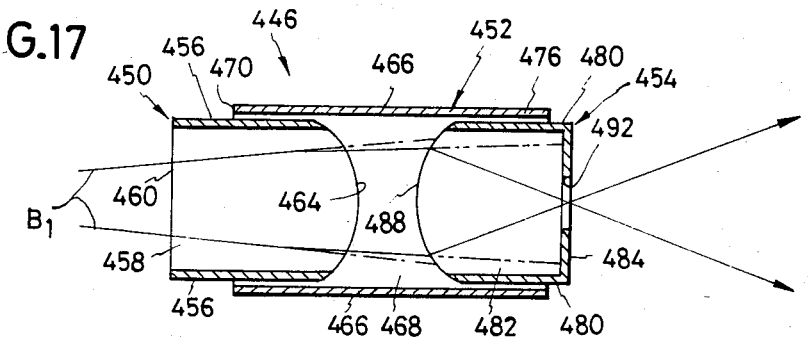
FIG. 17 is a vertical section through the lens system of FIG. 16, the view being explanatory of the deflection amplifying action of the lens system in a vertical direction.
Figure 18:
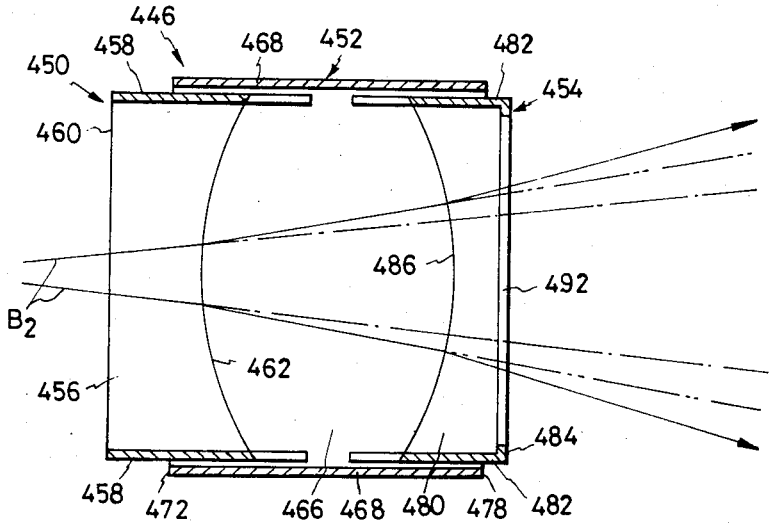
FIG. 18 is a horizontal section through the lens system of FIG. 16, the view being explanatory of the deflection amplifying action of the lens system in a horizontal direction.

Embodiment of FIGS. 16–18

In FIGS. 16 through 18 is shown a further scan expansion lens system 446 embodying our invention. This lens system comprises a gun side electrode 450, an intermediate electrode 452, and a target side electrode 454. These three electrodes are not arranged end to end as in the FIGS. 1 through 8 embodiment, but the gun side electrode 450 and target side electrode 454 are partly received in the opposite end portions of the intermediate electrode 452. In other words, the gun side electrode 450 and target side electrode 454 are opposed to each other with a spacing therebetween, and this spacing is thoroughly enclosed by the intermediate electrode 452, with the three electrodes 450, 452 and 454 being all in axial alignment with one another.

The gun side electrode 450 of the lens system 446 comprises a first pair of opposite sides 456 disposed horizontally, and a second pair of opposite sides 458 disposed vertically. The beam entrance ends 460 of the two pairs of opposite sides 456 and 458 are all straight and contained in a plane normal to the axis of the CRT 20. The beam exit ends 462 of the first pair of opposite sides 456 are each curved in an arc of a constant or varying radius that is convex toward the electron gun 30. The beam exit ends 464 of the second pair of opposite sides 458 are each curved in an arc of a constant or varying radius that is convex toward the target 28.

The intermediate electrode 452 of the lens system 446 comprises a first pair of opposite sides 466 disposed horizontally, and a second pair of opposite sides 468 disposed vertically. The beam entrance ends 470 and 472 of the two pairs of opposite sides 466 and 468 are all straight and extend at right angles with the axis of the CRT 20. The beam exit ends 476 and 478 of the two pairs of opposite sides 466 ad 468 are also all straight and at right angles with the axis of the CRT 20. In short, the intermediate electrode 452 is exactly boxlike in shape, open at both ends.

The target side electrode 454 of the lens system 446 comprises a first pair of opposite sides 480 disposed horizontally, a second pair of opposite sides 482 disposed vertically, and an apertured end plate 484 closing the beam exit end of the target side electrode. The beam entrance ends 486 of the first pair of opposite sides 480 of the target side electrode 454 are each curved in an arc of a constant or varying radius that is convex toward the target 28. The beam entrance ends 488 of the second pair of opposite sides 482 of the target side electrode 454 are each curved in an arc of a constant or varying radius that is convex toward the electron gun 30. The beam exit ends of the two pairs of opposite sides 480 and 482 area all straight and are arranged in a plane perpendicular to the axis of the CRT 20. Secured to these straight beam exit ends of the target side electrode 454, the end plate 484 is flat and has defined therein an aperture 492 of the same shape as that of the aperture 92 best illustrated in FIG. 6.

As will be noted from FIGS. 17 and 18, the gun side electrode 450 and target side electrode 454 are of approximately the same cross sectional size. These electrodes 450 and 454 are both partly received with clearances in the intermediate electrode 452, with the gun side electrode 450 projecting from the gun side end of the intermediate electrode and with the target side electrode 454 projecting from its target side end.

In the use of the lens system 446 in place of the lens system 46 in the CRT 20 of FIG. 1, a potential of 0 V may be applied to its gun side electrode 450, that of −1600 to −1400 V to its intermediate electrode 452, and that of 0 to 500 V to its target side electrode 454. Further a potential of 17.5 kV may be impressed to the postaccelerating electrode 48. Then the lens system 446 will act to amplify both verticall and horizontal deflections of the electron beam from the gun 30, as indicated by the vertical beam trajectories B1 of FIG. 17 and by the horizontal beam trajectories B2 of FIG. 18, in a manner analogous with the lens system 46 of FIGS. 1 through 8. The advantages arising from the improved shape of the end plate aperture 492 are also as previously set forth in connection with the FIGS. 1 through 8 embodiment.

The lens system 446 offers the additional advantage that the intermediate electrode 452 functions not only as such but also to shield the interior of the lens system as well as parts of the gun side electrode 450 and target side electrode 454. Shielding means for this lens system can therefore be simpler than that, for instance, for the lens system 46.

Figure 19:
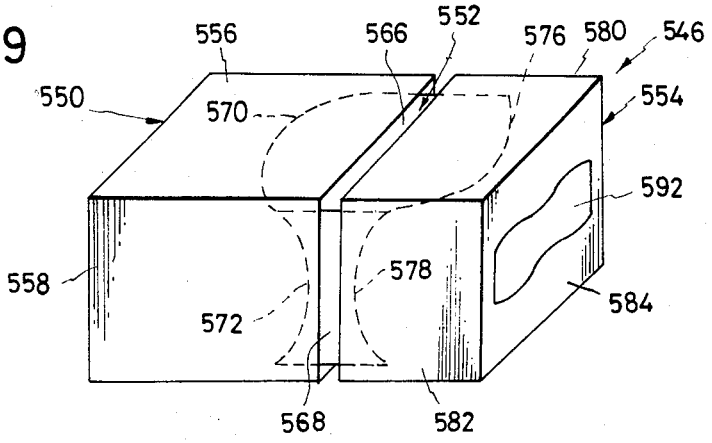
FIG. 19 is a perspective view of a still further preferred form of the scan expansion lens system in accordance with our invention.
Figure 20:
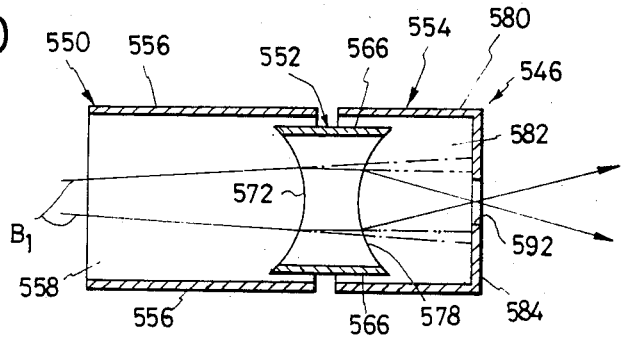
FIG. 20 is a vertical section through the lens system of FIG. 19, the view being explanatory of the deflection amplifying action of the lens system in a vertical direction.
Figure 21:
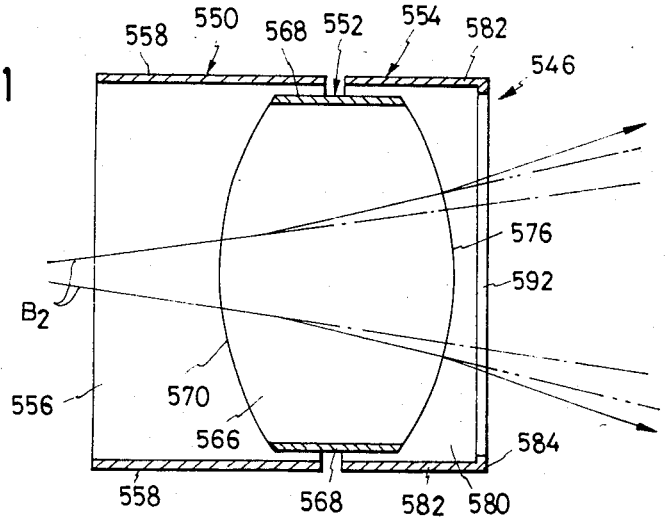
FIG. 21 is a horizontal section through the lens system of FIG. 19, the view being explanatory of the deflection amplifying action of the lens system in a horizontal direction.

Embodiment of FIGS. 19–21

A still further scan expansion lens system 546 of FIGS. 19 through 21 also comprises a gun side electrode 550, an intermediate electrode 552, and a target side electrode 554, all in axial alignment. In this embodiment, however, the intermediate electrode 552 is nested in the other two electrodes 550 and 554.

The gun side electrode 550 of the lens system 546 comprises a first pair of opposite sides 556 disposed horizontally, and a second pair of opposite sides 558 disposed vertically. The beam entrance end and beam exit end of the gun side electrode are all straight and contained in planes normal to the axis of the CRT 20. In short, the gun side electrode 550 is exactly boxlike in shape.

The intermediate electrode 552 of the lens system 546 comprises a first pair of opposite sides 566 disposed horizontally, and a second pair of opposite sides 568 disposed vertically. The beam entrance ends 570 of the first pair of opposite sides 566 are each curved in an arc of a constant or varying radius that is convex toward the electron gun 30. The beam entrance ends 572 of the second pair of opposite sides 568 are each curved in an arc of a constant or varying radius that is convex toward the target 28. The beam exit ends 576 of the first pair of opposite sides 566 are each curved in an arc of a constant or varying radius that is convex toward the target 28. The beam exit ends 578 of the second pair of opposite sides 568 are each curved in an arc of a constant or varying radius that is convex toward the electron gun 30.

The target side electrode 554 of the lens system 546 is also exactly boxlike in shape. It comprises a first pair of opposite sides 580 disposed respectively in a coplanar relationship to the first pair of opposite sides 556 of the gun side electrode 550, and a second pair of opposite sides 582 disposed respectively in a coplanar relationship to the second pair of opposite sides 558 of the gun side electrode 550. The beam entrance end and beam exit end of the target side electrode 554 are all straight and at right angles with the axis of the CRT 20. Also included in the target side electrode 554 is a flat end plate 584 closing its beam exit end and having defined therein an aperture 592 identical with the end plate aperture 92 of the FIGS. 1 through 8 embodiment.

The beam exit end of the gun side electrode 550 and the beam entrance end of the target side electrode 554 are opposed to each other with a spacing of, say, 3 mm therebetween. The intermediate electrode 552 is nested with clearances in the gun side electrode 550 and target side electrode 554, with the beam entrance end portion of the intermediate electrode received in the gun side electrode and its beam exit end portion received in the target side electrode.

The scan expansion lens system 546 of the foregoing configuration also finds use in the CRT 20 of FIG. 1, in substitution for the lens system 46. In operation a potential of 0 V may be applied to its gun side electrode 550, that of −1400 to −1200 V to its intermediate electrode 552, and that of 0 to 500 V to its target side electrode 554. Further a potential of 17.5 kV may be impressed to the postaccelerating electrode 48. Then the lens system 546 will act to amplify both verticall and horizontal deflections of the electron beam from the gun 30, as indicated by the vertical beam trajectories B1 of FIG. 20 and by the horizontal beam trajectories B2 of FIG. 21, in a manner analogous with the above described manner of operation of the lens system 46 of FIGS. 1 through 8. The advantages arising from the improved shape of the end plate aperture 592 are also as previously set forth in connection with the FIGS. 1 through 8 embodiment.

The lens system 446 offers the additional advantage that the gun side electrode 550 and target side electrode 554 serve also to shield the intermediate electrode 552.

Shielding means for this lens system can therefore be simplified.

Possible Modifications

Although we have shown and described our invention in terms of several preferable embodiments thereof, we recognize that these are by way of example only and not to impose limitations on our invention. A variety of modifications or adaptations of the illustrated embodiments will readily occur to one skilled in the art on the basis of this disclosure. The following, then, is a brief list of possible modifications that may be resoerted to without departing from the scope of our invention:

1. The lens system 46 of FIGS. 1 through 8 could be of a constant horizontal dimension throughout its axial lenth, instead of being trapezoidal in shape.

2. The apertured end plate 84 of the lens system 46 could be curved instead of being flat.

3. The lens systems 246, 346, 446 and 546 could be trapezoidal in shape like the lens system 46 and 146, gradually increasing in horizontal dimension from the beam entrance end toward the beam exit end.

4. In the lens system 46, the beam exit ends 62 and 64 of the gun side electrode 50, the beam entrance ends 70 and 72 and beam exit ends 76 and 78 of the intermediate electrode 52, and beam entrance ends 86 and 88 of the target side electrode 54 could all be convexed in directions opposite to those in which they were shown convexed.

5. In the other lens systems 146, 246, 446 and 546, too, the curved ends of the electrodes could be convexed in directions opposite to those in which they are shown convexed.

6. In the lens system 46, either or all of the beam exit ends 64 of the second pair of opposite sides 58 of the gun side electrode 50, the beam entrance ends 72 and beam exit ends 78 of the second pair of opposite sides 68 of the intermediate electrode 52, and the beam entrance ends 88 of the second pair of opposite sides 82 of the target side electrode 54 could be straight.

7. In the lens system 446 of FIGS. 16 through 18, the beam exit ends 464 of the second pair of opposite sides 458 of the gun side electrode 450 or the beam entrance ends 488 of the second pair of opposite sides 482 of the target side electrode 454 could be straight.

8. In the lens system 546 of FIGS. 19 through 21, the beam entrance ends 572 or beam exit ends 578 of the second pair of opposite sides 568 of the intermediate electrode 552 could be straight.

9. The corners of the two or three electrodes of all the lens systems 46, 146, 246, 346, 446 and 546 might be rounded as required or desired.

We further wish to point out that the illustrated configuration of the CRT 20 merely represents an example of possible applications of the scan expansion lens system in accordance with our invention. Thus, for example, a quadrupolar lens or lenses might be interposed between the electron gun and deflection system, and/or between the vertical and horizontal deflection plate pairs, of the CRT without departing from the scope of our invention. As has been mentioned, moreover, our invention is applicable not only to oscilloscope CRTs, as in the embodiments disclosed herein, but also to storage CRTs. In the latter application the standard collimation electrode will serve the purpose of the postaccelerating electrode for the lens system of our invention.

We claim:

1. Apparatus including a cathode ray tube having a target, an electron gun for emmiting a beam of electrons directed toward the target, deflection means disposed along the path of the beam for deflecting the beam in two orthogonal directions, a scan expansion lens system disposed along the path of the beam intermediate the deflection means and the target for amplifying the deflections of the beam, and a postaccelerating electrode disposed adjacent the scan expansion lens system so that an electric field due to the postaccelerating electrode acts at least upon a target side end portion of the lens system, the scan expansion lens system comprising:

(a) first and second tubular electrodes of substantially rectangular cross sectional shape disposed in axial alignment to allow the passage of the beam therethrough and spaced apart from each other with a gap sufficient to electrically insulate them from each other, each of the first and second electrodes having a beam entrance end directed toward the electron gun and a beam exit end directed toward the target;

(b) the first electrode having a first pair of opposite sides disposed in one of the two orthogonal directions of beam deflection and a second pair of opposite sides disposed in the other of the orthogonal directions;

(c) the second electrode having a third pair of opposite sides disposed in said one of the orthogonal directions and a fourth pair of opposite sides disposed in the other of the orthogonal directions, at least either of the beam exit ends of the first pair of opposite sides of the first electrode and the beam entrance ends of the third pair of opposite sides of the second electrode being each curved in an arc that is convex in a prescribed direction;

(d) the second electrode further having an end plate closing the beam exit end thereof, the end plate having defined therein an aperture generally elongated in said one of the orthogonal directions;

(e) the appartus further including means for applying prescribed electrical potentials to the first and second electrodes of the lens system and to the postaccelerating electrode to cause the lens system to amplify the deflections of the beam in both of the orthogonal directions by providing a divergent lens action in said one of the orthogonal directions and a convergent lens action in the other;

(f) the aperture in the end plate of the second electrode of the lens system gradually increasing, and then gradually decreasing, in its dimension in said other of the orthogonal directions from the midpoint of the aperture toward the opposite extremities thereof in said one of the orthogonal directions, whereby such equipotentials are created at and adjacent the end plate aperture of the second electrode by a potential difference between the second electrode and the postaccelerating electrode that the end plate aperture serves to amplify beam deflection in said one of the orthogonal directions without a sacrifice of the linearity of the deflection factor in that direction.

2. The appartus as set forth in claim 1, wherein a pair of opposite edges of the end plate of the second electrode of the scan expansion lens system generally extending in said one of the orthogonal directions and bonding the aperture therein are each composed of a convex central portion curved with a first radius, a pair of concave extreme portions each curved with a second radius, and a pair of linear portions intermediate the central portion and the extreme portions.

3. The apparatus as set forth in claim 2, wherein the dimension, in said other of the orthogonal directions, of the aperture in the end plate of the second electrode of the scan expansion lens system is at a minimum at the midpoint and opposite extremties of the aperture in said one of the orthogonal directions, and at a maximium at points intermediate the midpoint and opposite extremties thereof.

4. Apparatus including a cathode ray tube having a target, an electron gun for emitting a beam of electrons directed toward the target, deflection means disposed along the path of the beam for deflecting the beam in two orthogonal directions, a scan expansion lens system disposed along the path of the beam intermediate the deflection means and the target for amplifying the deflections of the beam, and a postaccelerating electrode disposed adjacent the scan expansion lens system so that an electric field due to the postaccelerating electrode acts at least upon a target side end portion of the lens system, the scan expansion lens system comprising:

(a) first, second and third tubular electrodes of substantially rectangular cross sectional shape disposed in axial alignment to allow the passage of the beam therethrough and spaced apart with a gap sufficient to electrically insulate them from one another, each of the first, second and third electrodes having a beam entrance end directed toward the electron gun and a beam exit end directed toward the target;

(b) the first electrode having a first pair of opposite sides disposed in one of the two orthogonal directions of beam deflection and a second pair of opposite sides disposed in the other of the orthogonal directions, the beam exit ends of the first pair of opposite sides being each curved in an arc that is convex in a first direction;

(c) the second electrode having a third pair of opposite sides disposed in said one of the orthogonal directions and a fourth pair of opposite sides disposed in the other of the orthogonal directions, the beam entrance ends of the third pair of opposite sides being each curved in an arc that is convex in said first direction and which is in conformity with the arcs of the beam exit ends of the first pair of opposite sides of the first electrode, the beam exit ends of the third pair of opposite sides being each curved in an arc that is convex in a second direction opposite to said first direction;

(d) the third electrode having a fifth pair of opposite sides disposed in said one of the orthogonal directions and a sixth pair of opposite sides disposed in the other of the orthogonal directions, the beam entrance ends of the fifth pair of opposite sides being each curved in an arc that is convex in said second direction and which is in conformity with the arcs of the beam exit ends of the third pair of opposite sides of the second electrode;

(e) the third electrode further having an end plate closing the beam exit end thereof, the end plate having defined therein an aperture generally elongated in said one of the orthogonal directions;

(f) the apparatus further including means for applying prescribed electrical potentials to the first, second and third electrodes of the lens system and to the postaccelerating electrode to cause the lens system to amplify the deflections of the beam in both of the orthogonal directions by providing a divergent lens action in said one of the orthogonal directions and a convergent lens action in the other;

(g) the aperture in the end plate of the third electrode of the lens system gradually increasing, and then gradually decreasing, in its dimension in said other of the orthogonal directions from the midpoint of the aperture toward the opposite extremities thereof in said one of the orthogonal directions, whereby such equipotentials are created at and adjacent the end plate aperture of the third electrode by a potential difference between the third electrode and the postaccelerating electrode that the end plate apertures serves to amplify beam deflection in said one of the orthogonal directions without a sacrifice of the linearity of the deflection factor in that direction.

5. The apparatus as set forth in claim 4, wherein the scan expansion lens system is generally trapezoidal in shape, gradually increasing in its dimension in said one of the orthogonal directions from the beam entrance end toward the beam exit end thereof.

6. Apparatus including a cathode ray tube having a target, an electron gun for emitting a beam of electrons directed toward the target, deflection means disposed along the path of the beam for deflecting the beam in two orthogonal directions, a scan expansion lens system disposed along the path of the beam intermediate the deflection means and the target for amplifying the deflections of the beam, and a postaccelerating electrode disposed adjacent the scan expansion lens system so that an electric field due to the postaccelerating electrode acts at least upon a target side end portion of the lens system, the scan expansion lens system comprising:

(a) first and second tubular electrodes of substantially rectangular cross sectional shape disposed in axial alignment to allow the passage of the beam therethrough, each of the first and second electrodes having a beam entrance end directed toward the electron gun and a beam exit end directed toward the target, the second electrode enveloping at least a beam exit end portion of the first electrode with a clearance sufficient to electrically insulate them from each other;

(b) the first electrode having a first pair of opposite sides disposed in one of the two orthogonal directions of beam deflection and a second pair of opposite sides disposed in the other of the orthogonal directions, the beam exit ends of the first pair of opposite sides being each curved in an arc that is convex in a first direction, the beam exit ends of the second pair of opposite sides being each curved in an arc that is convex in a second direction opposite to the first direction;

(c) the second electrode having a third pair of opposite sides disposed in said one of the orthogonal directions and a fourth pair of opposite sides disposed in the other of the orthogonal directions;

(d) the second electrode further having an end plate closing the beam exit end thereof, the end plate having defined therein an aperture generally elongated in said one of the orthogonal directions;

(e) the apparatus further including means for applying prescribed electrical potentials to the first and second electrodes of the lens system and to the postaccelerating electrode of cause the lens system to amplify the deflections of the beam in both of the orthogonal directions by providing a divergent lens action in said one of the orthogonal directions and a convergent lens action in the other;

(f) the aperture in the end plate of the second electrode of the lens system gradually increasing, and then gradually decreasing, in its dimension in said other of the orthogonal directions from the midpoint of the aperture toward the opposite extremities thereof in said one of the orthogonal directions, whereby such equipotentials are created at and adjacent the end plate aperture of the second electrode by a potential difference between the second electrode and the postaccelerating electrode that the end plate aperture serves to amplify beam deflection in said one of the orthogonal directions without a sacrifice of the linearity of the deflection factor in that direction.

7. The apparatus as set forth in claim 6, wherein the beam exit ends of the first pair of opposite sides of the second electrode of the scan expansion lens system are each curved in an arc that is convex in said second direction, and wherein the end plate of the second electrode is curved in conformity with the beam exit ends of the first pair of opposite sides of the second electrode.

8. Apparatus including a cathode ray tube having a target, an electron gun for emitting a beam of electrons directed toward the target, deflection means disposed along the path of the beam for deflecting the beam in two orthogonal directions, a scan expansion lens system disposed along the path of the beam intermediate the deflection means and the target for amplifying the deflections of the beam, and a postaccelerating electrode disposed adjacent the scan expansion lens system so that an electric field due to the postaccelerating electrode acts at least upon a target side end portion of the lens system, the scan expansion lens system comprising:

(a) first and second tubular electrodes of substantially rectangular cross sectional shape disposed in axial alignment to allow the passage of the beam therethrough, each of the first and second electrodes having a beam entrance end directed toward the electron gun and a beam exit end directed toward the target, the first electrode enveloping a beam exit end portion of the second electrode with a clearance sufficient to electrically insulate them from each other;

(b) the first electrode having a first pair of opposite sides disposed in one of the two orthogonal directions of beam deflection and a second pair of opposite sides disposed in the other of the orthogonal directions;

(c) the second electrode having a third pair of opposite sides disposed in said one of the orthogonal directions and a fourth pair of opposite sides disposed in the other of the orthogonal directions, the beam entrance ends of the third pair of opposite sides being each curved in an arc that is convex in a first direction, the beam entrance ends of the fourth pair of opposite sides being each curved in an arc that is convex in a second direction opposite to the first direction;

(d) the second electrode further having an end plate closing the beam exit end thereof, the end plate having defined therein an aperture generally elongated in said one of the orthogonal directions;

(e) the apparatus further including means for applying prescribed electrical potentials to the first and second electrodes of the lens system and to the postaccelerating electrode to cause the lens system to amplify the deflections of the beam in both of the orthogonal directions by providing a divergent lens action in said one of the orthogonal directions and a convergent lens action in the other;

(f) the aperture in the end plate of the second electrode of the lens system gradually increasing, and then gradually decreasing, in its dimension in said other of the orthogonal directions from the midpoint of the aperture toward the opposite extremities thereof in said one of the orthogonal directions, whereby such equipotentials are created at and adjacent the end plate aperture of the second electrode by a potential difference between the second electrode and the postaccelerating electrode that the end plate aperture serves to amplify beam deflection in said one of the orthogonal directions without a sacrifice of the linearity of the deflection factor in that direction.

9. Apparatus including a cathode ray tube having a target, an electron gun for emitting a beam of electrons directed toward the target, deflection means disposed along the path of the beam for deflecting the beam in two orthogonal directions, a scan expansion lens system disposed along the path of the beam intermediate the deflection means and the target for amplifying the deflections of the beam, and a postaccelerating electrode disposed adjacent the scan expansion lens system so that an electric field due to the postaccelerating electrode acts at least upon a target side end portion of the lens system, the scan expansion lens system comprising:

(a) first, second and third tubular electrodes of substantially rectangular cross sectional shape disposed in axial alignment to allow the passage of the beam therethrough, each of the first, second and third electrodes having a beam entrance end directed toward the electron gun and a beam exit end directed toward the target, the second electrode enveloping at least a beam exit end portion of the first electrode and a beam entrance end portion of the third electrode with clearances sufficient to electrically isolate the three electrodes from one another;

(b) the first electrode having a first pair of opposite sides disposed in one of the two orthogonal directions of beam deflection and a second pair of opposite sides disposed in the other of the orthogonal directions, the beam exit ends of the first pair of opposite sides being each curved in an arc that is convex in a first direction;

(c) the second electrode having a third pair of opposite sides disposed in said one of the orthogonal directions and a fourth pair of opposite sides disposed in the other of the orthogonal directions;

(d) the third electrode having a fifth pair of opposite sides disposed in said one of the orthogonal directions and a sixth pair of opposite sides disposed in the other of the orthogonal directions, the beam entrance ends of the fifth pair of opposite sides being each curved in an arc that is convex in a second direction opposite to the first direction, at least either of the beam exit ends of the second pair of opposite sides of the first electrode and the beam entrance ends of the sixth pair of opposite sides of the third electrode being curved in an arc that is convex in a prescribed one of the first and second directions;

(e) the third electrode further having an end plate closing the beam exit end thereof, the end plate having defined therein an aperture generally elongated in said one of the orthogonal directions;

(f) the apparatus further including means for applying prescribed electrical potentials to the first, second and third electrodes of the lens system and to the postaccelerating electrode to cause the lens system to amplifying the deflections of the beam in both of the orthogonal directions by providing a divergent lens action in said one of the orthogonal directions and a convergent lens action in the other;

(g) the aperture in the end plate of the third electrode of the lens system gradually increasing, and then gradually decreasing, in its dimension in said other of the orthogonal directions from the midpoint of the aperture toward the opposite extremities thereof in said one of the orthogonal directions, whereby such equipotentials are created at and adjacent the end plate aperture of the third electrode by a potential difference between the third electrode and the postaccelerating electrode that the end plate aperture serves to amplify beam deflection in said one of the orthogonal directions without a sacrifice of the linearity of the deflection factor in that direction.

10. The apparatus as set forth in claim 9, wherein the beam exit ends of the second pair of opposite sides of the first electrode of the scan expansion lens system are each curved in an arc that is convex in the second direction.

11. The apparatus as set forth in claim 9, wherein the beam entrance ends of the sixth pair of opposite sides of the third electrode of the scan expansion lens system are each curved in an arc that is convex in the first direction.

12. Apparatus including a cathode ray tube having a target, an electron gun for emitting a beam of electrons directed toward the target, deflection means disposed along the path of the beam for deflecting the beam in two orthogonal directions, a scan expansion lens system disposed along the path of the beam intermediate the deflection means and the target for amplifying the deflections of the beam, and a postaccelerating electrode disposed adjacent the scan expansion lens system so that an electric field due to the postaccelerating electrode acts at least upon a target side end portion of the lens system, the scan expansion lens system comprising:

(a) first, second and third tubular electrodes of substantially rectangular cross sectional shape disposed in axial alignment to allow the passage of the beam therethrough, each of the first, second and third electrodes having a beam entrance end directed toward the electron gun and a beam exit end directed toward the target, the beam exit end of the first electrode being held opposite the beam entrance end of the third electrode with a gap therebetween sufficient to electrically insulate them from each other, the second electrode having a beam entrance end portion received in the first electrode and having a beam exit end portion received in the third electrode with clearances sufficient to electrically insulate the second electrode from the first and third electrodes, (b) the first electrode having a first pair of opposite sides disposed in one of the two orthogonal directions of beam deflection and a second pair of opposite sides disposed in the other of the orthogonal directions;

(c) the second electrode having a third pair of opposite sides disposed in said one of the orthogonal directions and a fourth pair of opposite sides disposed in the other of the orthogonal directions, the beam entrance ends of the third pair of opposite sides being each curved in an arc that is convex in a first direction, the beam exit ends of the third pair of opposite sides being each curved in an arc that is convex in a second direction opposite to the first direction, at least either of the beam entrance ends and beam exit ends of the fourth pair of opposite sides being each curved in an arc that is convex in a prescribed one of the first and second directions;

(d) the third electrode having a fifth pair of opposite sides disposed in said one of the orthogonal directions and a sixth pair of opposite sides disposed in the other of the orthogonal directions;

(e) the third electrode further having an end plate closing the beam exit end thereof, the end plate having defined therein an aperture generally elongated in said one of the orthogonal directions;

(f) the apparatus further including means for applying prescribed electrical potentials to the first, second and third electrodes of the lens system and to the postaccelerating electrode to cause the lens system to amplify the deflections of the beam in both of the orthogonal directions by providing a divergent lens action in said one of the orthogonal directions and a convergent lens action in the other;

(g) the aperture in the end plate of the third electrode of the lens system gradually increasing, and then gradually decreasing, in its dimension in said other of the orthogonal directions from the midpoint of the aperture toward the opposite extremities thereof in said one of the orthogonal directions, whereby such equipotentials are created at and adjacent the end plate aperture of the third electrode by a potential difference between the third electrode and the postaccelerating electrode that the end plate aperture serves to amplify beam deflection in said one of the orthogonal directions without a sacrifice of the linearity of the deflection factor in that direction.

13. The apparatus as set forth in claim 12, wherein the beam entrance ends of the fourth pair of opposite sides of the second electrode of the scan expansion lens system are each curved in an arc that is convex in the second direction.

14. The apparatus as set forth in claim 12, wherein the beam exit ends of the fourth pair of opposite sides of the second electrode of the scan expansion lens system are each curved in an arc that is convex in the first direction.

* * * * *